US010569915B2

(12) United States Patent
Zucchini

(10) Patent No.: US 10,569,915 B2
(45) Date of Patent: Feb. 25, 2020

(54) PACKAGING MACHINE WITH A FLUID PUMP ASSEMBLY

(71) Applicant: Multivac Sepp Haggenmüller GmbH & Co. KG, Wolfertschwenden (DE)

(72) Inventor: Marco Zucchini, Argelato (IT)

(73) Assignee: Multivac Sepp Haggenmüller SE & Co. KG, Wolfertschwenden (DE)

( * ) Notice: Subject to any disclaimer, the term of this patent is extended or adjusted under 35 U.S.C. 154(b) by 772 days.

(21) Appl. No.: 14/981,354

(22) Filed: Dec. 28, 2015

(65) Prior Publication Data

US 2016/0185473 A1 Jun. 30, 2016

(30) Foreign Application Priority Data

Dec. 30, 2014 (EP) ..... 14200623

(51) Int. Cl.

| | |
|---|---|
| ***B65B 31/02*** | (2006.01) |
| ***F04B 35/01*** | (2006.01) |
| ***F04B 49/22*** | (2006.01) |
| ***F04B 39/12*** | (2006.01) |
| ***F04B 53/14*** | (2006.01) |
| ***F04B 53/10*** | (2006.01) |
| ***F04B 25/04*** | (2006.01) |
| ***F04B 41/06*** | (2006.01) |
| ***F04B 37/14*** | (2006.01) |
| ***F04B 27/04*** | (2006.01) |
| ***F04B 25/00*** | (2006.01) |

(52) U.S. Cl.

CPC ..... *B65B 31/02* (2013.01); *F04B 25/00* (2013.01); *F04B 27/04* (2013.01); *F04B 37/14* (2013.01)

(58) Field of Classification Search

CPC ..... F04B 25/00; F04B 27/04; F04B 37/14; B65B 31/02

See application file for complete search history.

(56) References Cited

U.S. PATENT DOCUMENTS 2,404,175 A 7/1946 Holden et al.
4,313,714 A * 2/1982 Kubeczka ..... F04B 1/053 417/273

(Continued)

FOREIGN PATENT DOCUMENTS

CN 202125416 U 1/2012
CN 103436659 A 12/2013

(Continued)

OTHER PUBLICATIONS

English Translation of JP-2006009722, 2006.*

*Primary Examiner* — Dominick L Plakkoottam
(74) *Attorney, Agent, or Firm* — Husch Blackwell LLP

(57) ABSTRACT

The invention is directed to a packaging machine with a fluid pump assembly of the radial cylinder type, the assembly comprising a plurality of at least three pumps. Each pump has a piston guided in a cylinder, as well as a high pressure port and a low pressure port. A manifold is provided connecting the high pressure ports of a first group of first stage pumps so that the pumps of this first group are operatively connected in parallel, while at least one second stage pump is operatively connected to the first group of pumps in series. The invention is further directed to a method for generating a vacuum in a packaging machine with a fluid pump assembly.

17 Claims, 7 Drawing Sheets

(56) References Cited

U.S. PATENT DOCUMENTS

| | | | | |
|---|---|---|---|---|
| 5,482,443 | A * | 1/1996 | Bez | F04B 25/02 417/266 |
| 8,011,898 | B2 * | 9/2011 | Courier | F04B 1/0531 219/201 |
| 9,764,868 | B2 | 9/2017 | Hu et al. | |
| 9,835,129 | B2 * | 12/2017 | Nedberg | F03B 17/005 |
| 2013/0259711 | A1 | 10/2013 | Burggraf et al. | |
| 2015/0135641 | A1 * | 5/2015 | Hu | B65B 51/10 53/86 |
| 2015/0377226 | A1 * | 12/2015 | Stones | F04B 37/14 454/341 |

FOREIGN PATENT DOCUMENTS

| | | | |
|---|---|---|---|
| CN | 203601616 | U | 5/2014 |
| CN | 203604141 | U | 5/2014 |
| DE | 3312970 | A1 | 10/1984 |
| DE | 9007487 | U1 | 1/1992 |
| DE | 19626938 | A1 | 1/1998 |
| DE | 19948445 | A1 | 4/2001 |
| DE | 102007029670 | A1 | 4/2008 |
| DE | 102010013889 | A1 | 10/2011 |
| DE | 102012004372 | A1 | 9/2013 |
| DE | 102012017827 | A1 | 3/2014 |
| DE | 102012024725 | A1 | 6/2014 |
| JP | 2006009722 | A * | 1/2006 |
| JP | 2006009722 | A | 1/2006 |
| TW | 201209284 | A1 | 3/2012 |

* cited by examiner

PACKAGING MACHINE WITH A FLUID PUMP ASSEMBLY

CROSS-REFERENCE TO RELATED APPLICATIONS

This Application claims priority to European Patent Application Number 14200623.8 filed Dec. 30, 2014, to Marco Zucchini, currently pending, the entire disclosure of which is incorporated herein by reference.

FIELD OF THE INVENTION

The invention is directed to a packaging machine comprising a fluid pump assembly of the radial cylinder type and to a method of generating a vacuum in a packaging machine.

BACKGROUND OF THE INVENTION

Packaging machines exist in several different types. For example, a chamber packaging machine is known from DE 10 2012 017 827 A1. A belted chamber packaging machine is disclosed in DE 10 2010 013 889 A1. A thermoforming packaging machine is disclosed in DE 10 2012 024 725 A1. A tray sealing packaging machine, also simply referred to as a tray sealer, is described in DE 10 2012 004 372 A1. Generally, a packaging machine can be characterized as typically comprising a sealing tool or sealing station for hermetically sealing a cover foil to a filled packaging. The disclosure of the aforementioned documents is incorporated herein with respect to the detailed description of the different types of packaging machines.

Fluid pump assemblies of the radial cylinder type are known, for example, from U.S. Pat. No. 2,404,175, DE 33 12 970 C2, DE 196 26 938 A1 or DE 199 48 445 A1. Such fluid pump assemblies of the radial cylinder type comprise a plurality of pumps radially projecting from a center in which a drive for the individual pumps is provided. Typically, as disclosed in the latter two references, such fluid pump assemblies are used in the automotive industry, for example in vehicle braking systems.

DE 90 07 487 U1 discloses a radial cylinder type fluid assembly with three piston pumps.

A radial cylinder pump is comparable in its basic configuration to a radial engine in having a plurality of cylinders with pistons which "radiate" outward from a central point. This configuration generally resembles a star. Hence, the configuration may also be called a "star pump assembly."

Such radial cylinder pumps offer the advantage of low noise generation combined with a rather smooth, constant output. This is achieved by operating each of the plurality of pumps in turn. Another expression for a fluid pump assembly of the radial cylinder type simply is "radial piston pump."

SUMMARY OF THE INVENTION

One object of the present invention is to provide packaging machine with an improved way of generating a vacuum.

One embodiment of the invention is directed to a packaging machine with a fluid pump assembly of the radial cylinder type or, in short, a radial piston pump assembly. This pump assembly comprises a plurality of at least three individual pumps, for example 3, 4, 5, 6 or 8 pumps. All of these pumps radially project away from a common center. Each pump may have the same configuration, and may have the same or substantially the same capacity. For example, the capacity may differ from pump to pump by a maximum of +/−2% or +/−5%.

According to one embodiment of the invention, a manifold is provided connecting the high pressure ports of a first group of pumps, so that the pumps of this group (for easier understanding termed first stage pumps) are operatively connected in parallel, and in that at least one second stage pump or a plurality of second stage pumps are operatively connected to the first group of pumps in series. In this context, "operatively connected" does not refer to the spatial arrangement of the pumps, but to the functional arrangement in which high pressure ports and low pressure ports of the pumps are connected, respectively. In particular, several pumps may be connected in parallel by connecting the low pressure ports of all pumps, or the high pressure ports of each pump, respectively. Two pumps can be operatively connected in series when the high pressure port of one pump is connected to the low pressure port of another pump.

In the context of the present invention, the "low pressure port" of each pump is the port from which the pump, when operated has a suction pump or a vacuum pump, draws fluid (or air, respectively). The "high pressure port", on the other hand, is the port to which the pump delivers higher pressure fluid. All pumps may be vacuum pumps or air pumps.

The inventive connection of the high pressure ports of the first stage pumps by a manifold offers the advantage of being able to quickly produce a certain vacuum pressure, because several first stage pumps participate in jointly producing this vacuum. In particular, the manifold may be connected with a closeable first discharge port (in the following termed vacuum port) to which the air (or other fluid) being drawn by the first stage pumps can be delivered. Having then at least one or several second stage pumps operatively connected to the first group of pumps in series offers the ability to produce an even lower vacuum pressure. This may be achieved by closing the first (vacuum) port and opening a second discharge port (in the following termed second vacuum port) on the opposite side of the second stage pumps than the first (vacuum) port. In this second mode of operation, a vacuum is drawn with the first stage pumps and the at least one second stage pump operatively connected in series. In total, the fluid pump assembly of the present invention offers a first mode of operation for quickly producing a first vacuum level, and a second mode of operation for achieving an even lower vacuum level.

In order to achieve this purpose, the second stage pump, or at least the one second stage pump which operatively is closest to the first group of pumps, may be connected in series to the high pressure ports of the first stage pumps. For example, the low pressure port of the second stage pump may be operatively connected to the manifold connecting the high pressure ports of the first stage pumps.

The use of the fluid pump assembly described herein may be ideal for generating a vacuum within a packaging machine. On the one hand, the fluid pump assembly, when used as a vacuum pump assembly, allows both a rapid generation of vacuum and a generation of a very low vacuum pressure. This increases the productivity of the packaging machine, i.e., the number of packagings which can be completed within a certain time. The fluid pump assembly may be very compact and not generate noise at a noticeable level.

Each pump in the fluid pump assembly has a maximum volume of about 10 $cm^3$ in one embodiment, and about 5 $cm^3$ in another embodiment. This value relates either to the internal volume of the cylinder of the respective pump or to the fluid volume which is delivered by the pump upon one complete operating cycle of its piston. For example, a volume of 5 $cm^3$ can be obtained by operating a piston with a diameter or 23 mm and an amplitude of movement of 12 mm.

In order to allow an easy operation, all pumps of the fluid pump assembly may be driven by a common driving shaft. For example, an eccentric driving shaft or an external eccentric tappet, such as a stroke ring, may be provided for cyclically operating each pump in turn. At the same time, this can ensure a smooth, low-noise operation of the fluid pump assembly.

The first group of first stage pumps may comprise 2, 3 or 4 individual pumps. In this way, the available pumping capacity for producing a vacuum is multiplied by the number of participating first stage pumps, compared to only a single pump, thereby ensuring a rapid generation of the first level vacuum.

The at least one second stage pump can comprise a second group of pumps, the pumps of this second group being operatively connected to each other in parallel. Jointly, however, the pumps of this second group are still operatively connected to the first stage pumps in series. The provision of a group of second stage pumps can allow for a more rapid achievement of a second, lower vacuum level.

In addition to, or alternatively to, having such a second group of second stage pumps connected to each other in parallel, it is possible to have a plurality of second stage pumps which are operatively connected to each other in series. The higher the number of (groups of) pumps connected to each other in series in total, the lower the vacuum pressure which can be produced by the fluid pump assembly.

For example, the second stage pumps may comprise at least two or three pumps which are mutually operatively connected in series. Together with the first stage pumps, there are in total three or four "stages" of pumps, respectively. Provided that there is a sufficient number of pumps in total, it is certainly conceivable to have more than three second stage pumps connected to each other in series.

A check valve may be provided at the high pressure port and/or a check valve may be provided at the low pressure port of a pump. It is even possible to have a check valve at the high pressure port and another check valve at the low pressure port of each pump in the fluid pump assembly. The check valve can prevent a back flow of fluid and, hence, ensure a reliable operation.

In one configuration of the fluid pump assembly, a second manifold is provided connecting the low pressure ports of the first group of first stage pumps. This will ensure that the operating conditions are equal for each pump. In addition, this offers the advantage of necessitating only a single suction port from the second manifold to the chamber or volume that is to be evacuated.

The packaging machine itself may, for example, be a chamber packaging machine, a belted chamber packaging machine, a tray sealing packaging machine or a thermoforming packaging machine. In particular, the sealing station of such a packaging machine may be provided with a fluid pump assembly according to the present invention, operated as a vacuum pump assembly.

Another aspect of the present invention relates to a method for generating a vacuum within a packaging machine, in particular a vacuum chamber packaging machine, with a fluid pump assembly of the radial cylinder type. The assembly can comprise a plurality of at least three pumps, each pump having a piston guided in a cylinder, a high pressure port and a low pressure port. One embodiment of the method comprises the following steps:

operating a first group of first stage pumps to generate a vacuum at a first vacuum port, the members of the first group of pumps being operatively connected to each other in parallel, closing the first vacuum port, and operatively connected to the first group of pumps in series to jointly generate a vacuum at a second vacuum port.

As described above, this method may allow for the generation of a first vacuum level with the first method step (or first mode of operation, respectively), and the generation of an even lower vacuum level with the third method step (or the second mode of operation, respectively). This makes the invention particularly interesting for use in the packaging industry, in particular in a packaging machine.

All pumps may be driven by a common driving shaft.

The operation of the at least one second stage pump can comprise the generation of vacuum by a plurality of pumps which may be operatively connected in series to each other and to the first group of first stage pumps. This allows the generation of even lower vacuum levels than in a situation with only a single second stage pump.

The method according to the present invention may also comprise the monitoring of a pressure or of a time elapsed, and closing the first vacuum port when a pre-determined pressure has been reached or a pre-determined time has elapsed, respectively. For example, the time duration may be measured from starting to operate a pumping activity, or from opening the first vacuum port, respectively.

Other and further objects of the invention, together with the features of novelty appurtenant thereto, will appear in the course of the following description.

DESCRIPTION OF THE SEVERAL VIEWS OF THE DRAWING

In the following, preferred embodiments of the invention will be described with respect to the accompanying drawings.

Same and corresponding components are labeled with the same reference numerals throughout the drawings.

DETAILED DESCRIPTION OF THE INVENTION

Figure 1:
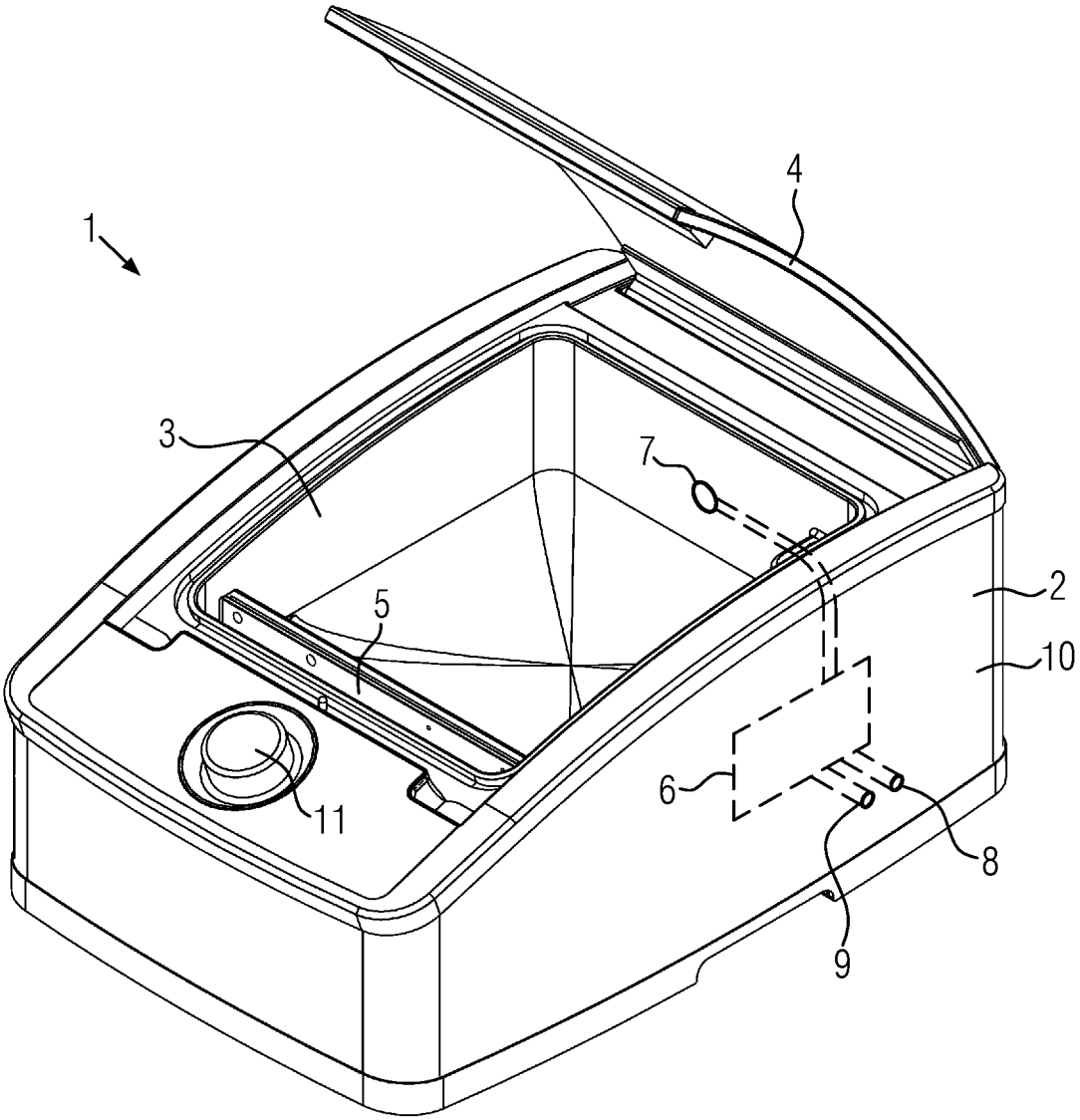
FIG. 1 is a perspective view of a packaging machine according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a perspective view of a packaging machine 1 of one embodiment of the present invention. This packaging machine 1 is embodied as a (vacuum) chamber packaging machine comprising a housing 2 containing a vacuum chamber 3 which is closeable by a pivotable cover 4. A sealing tool 5, here configured as a longitudinal sealing bar 5, can be arranged within the vacuum chamber 3.

A fluid pump assembly 6, as further described below, may be contained within the housing 2. The fluid pump assembly 6 can comprise a suction opening or suction port 7 arranged in a wall of the vacuum chamber 3. If desired, the suction port 7 may comprise several openings. The fluid pump assembly 6 may further comprise a first (vacuum) port 8, such as a first discharge port, and a second (vacuum) port 9, such as a second discharge port, arranged in the outer wall 10 of the housing 2 and connecting the fluid pump assembly 6 to the environment, i.e., to ambient air pressure. If desired, the first and second (vacuum) ports 8, 9 may also coincide, or may be connected to each other within the housing 2, such that only one opening leads out of the housing 2.

Further, the packaging machine 1 can comprise control elements 11, such as a control knob. It may further comprise a display (not shown).

In operation, a packaging to be hermetically sealed is placed within the vacuum chamber 3. The opening of the packaging, typically a pouch, is placed above the sealing bar 5. After closing the cover 4 and operating a control element 11, the fluid pump assembly 6 is operated as a vacuum pump assembly. In doing so, remaining air can be drawn from the vacuum chamber 3 via the suction port 7 and discharged to the environment via the first and second (vacuum) port 8, 9, as described below. When a desired vacuum level has been reached, the packaging can be sealed by applying a predetermined pressure and sealing temperature via the sealing bar 5. Subsequently, the cover 4 is opened to remove the hermetically sealed packaging from the chamber packaging machine 1.

Figure 2:
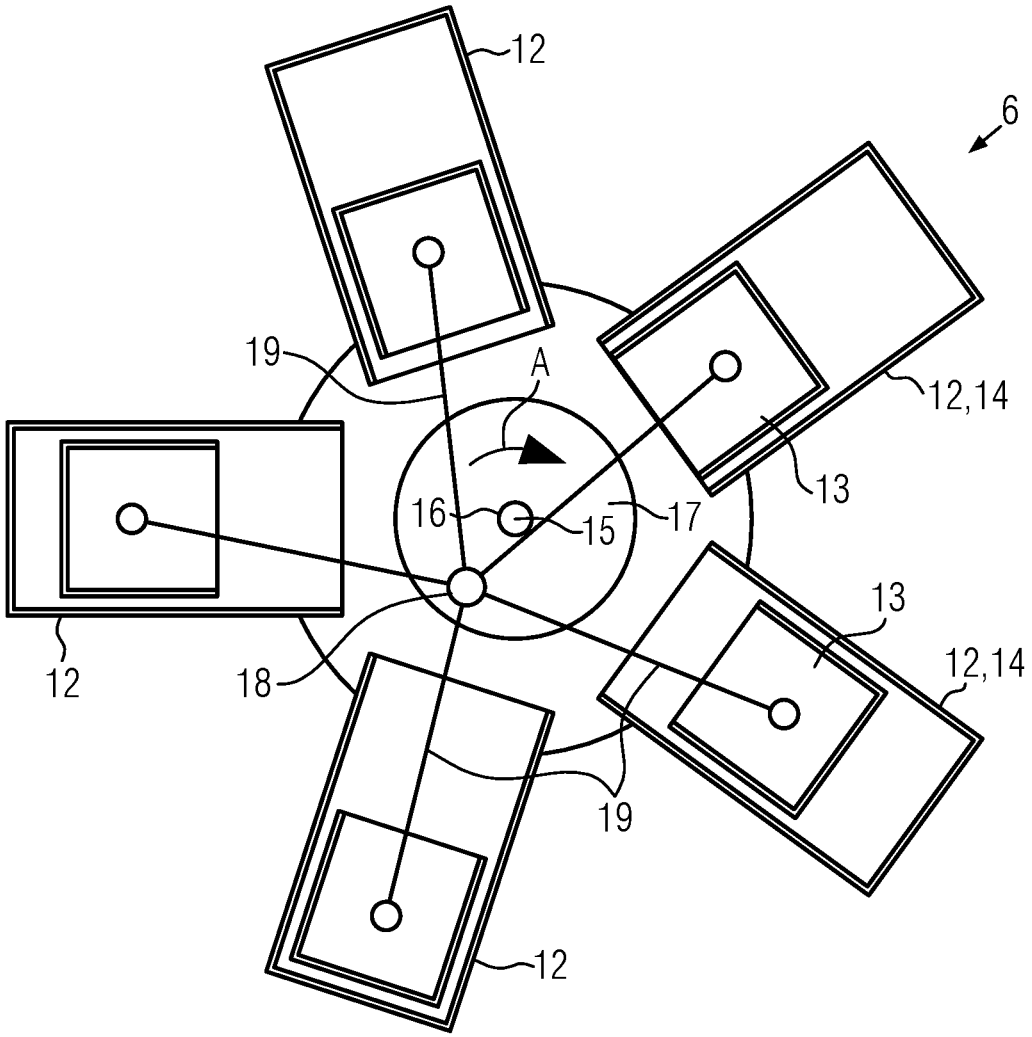
FIG. 2 is a schematic view of a fluid pump assembly according to one embodiment of the present invention.

FIG. 2 shows a schematic layout of a fluid pump assembly of the radial cylinder type according to one embodiment of the invention, in short a radial piston pump assembly 6. As shown, this fluid pump assembly 6 comprises five individual pumps 12. Each pump 12 has a piston 13 guided in a cylinder 14 for reciprocating movement. The dimensions of each pump 12 as well as the stroke or amplitude of the movement of each piston 13 within the cylinder 14 is generally identical. Hence, each pump 12 has generally the same capacity.

As shown in FIG. 2, the five pumps 12 are arranged in an equidistant manner, leading to a star-shaped configuration, in which their axes mutually intersect at a common center 15. A common driving shaft 16 is arranged at this center 15. The driving shaft 16 is rotatable about its axis (at 15) to rotatably drive a rotating ring 17 connected with the driving shaft 16. An eccentric tappet 18 can be arranged eccentrically on the rotating ring 17. A rod or mechanical link 19 is provided for each pump 12, pivotably being connected to the eccentric tappet 18 at an inner end and pivotably being connected to the respective piston 13 at its outer end.

In operation, when the driving shaft 16 rotates about its axis (at 15), as represented by the arrow A, the eccentric tappet 18 moves on a circular trajectory about the driving shaft 16. This will lead to reciprocating movement of the pistons 13 and, therefore, pumping activity of all pumps 12. Each pump 12 is operated at a different phase in its pumping cycle compared to the adjacent pumps 12. When representing a complete pumping cycle by 360°, the phase difference between two adjacent pumps 12 amounts to 360° divided by the total number of pumps 12. In the present case with five pumps 12, the phase difference between adjacent pumps amounts to 72°.

Figure 3:
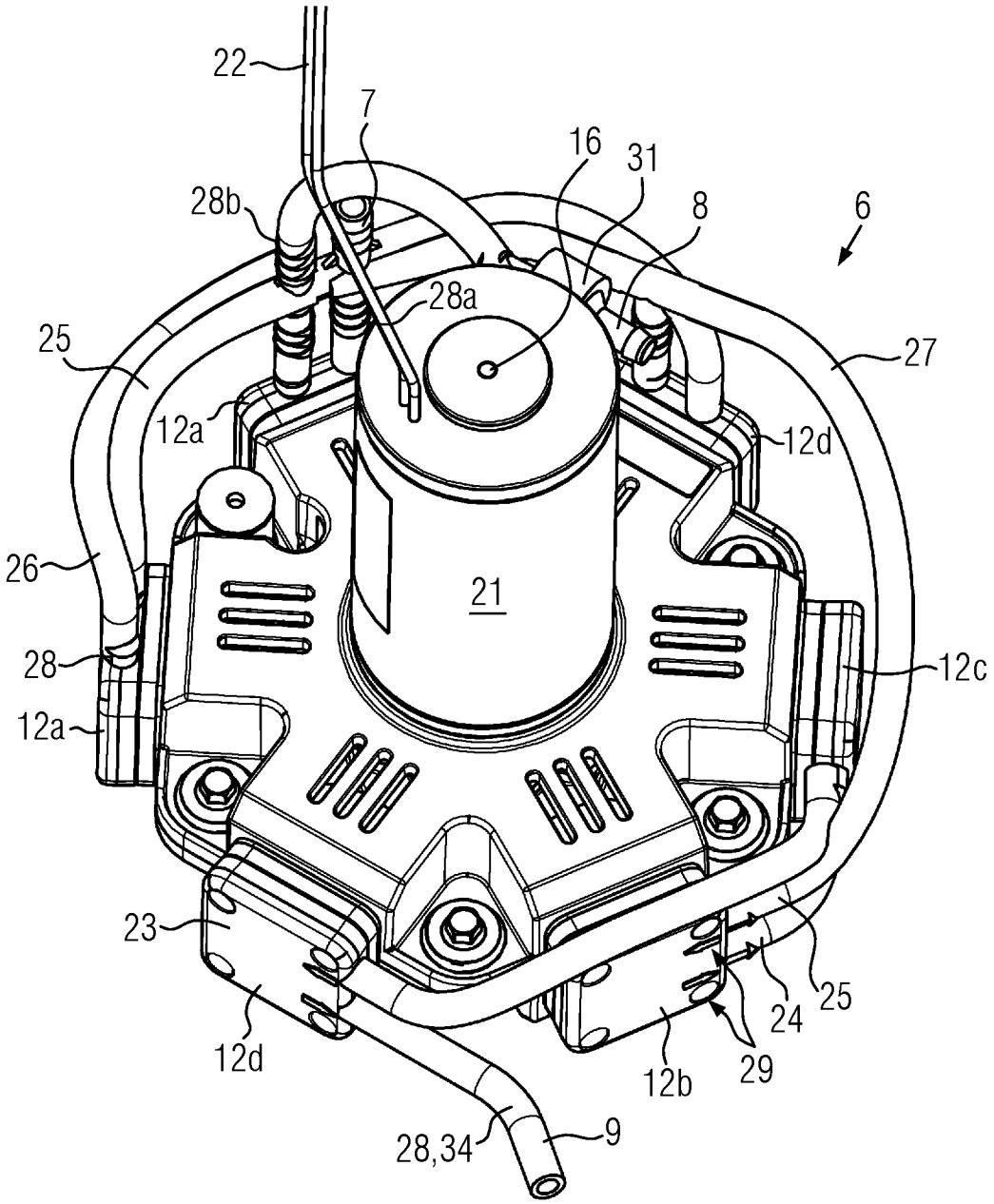
FIG. 3 is a perspective view of a fluid pump assembly according to one embodiment of the present invention.

FIG. 3 shows a perspective view of the fluid pump assembly 6. The fluid pump assembly 6 can comprise a pump housing 20, for example, from plastic material or cast metal. All five pumps 12 may be accommodated in the same pump housing 20. An electrical motor 21 may be arranged above the pump housing 20. The motor 21 is provided with electricity via a wiring 22, and is configured to rotatingly drive the driving shaft 16.

For each pump, a connector block 23 projects radially outward from the substantially disc-shaped pump housing 20. Each connector block 23 may accommodate a high pressure port 24 and a low pressure port 25 of each pump 12. When operating as a vacuum pump, the pump 12 draws air from the low pressure port 25 and discharges compressed air at a higher pressure at its high pressure port 24.

A first manifold 26 may operatively connect the high pressure ports 24 of several pumps 12, in the present embodiment of three pumps 12*a*. The first manifold 26 can comprise a plurality of flexible tubes 27 interconnected to each other and to the ports 24, respectively, by plastic connector pieces 28. One of the connector pieces may be configured as a T-joint connector piece 28*a*. Another connector piece 28*b* may have a cross-shaped configuration, i.e., it has four exits. A check valve 29 configured to prevent backflow can be arranged for each port 24, 25 within each connector block 23. The check valve 29 at the high pressure port 24 prevents backflow of fluid into the corresponding pump 12, while the check valve 29 at the low pressure port 25 prevents backflow of fluid from the respective pump.

Further pumps 12*b*-12*d* may be operatively connected by another manifold 33 which, again, comprises a plurality of flexible tubes 27 interconnected by connector pieces 28. A linear connector piece 28 housing a second closing valve 34 can constitute the second vacuum port 9 of the fluid pump assembly.

Figure 4:
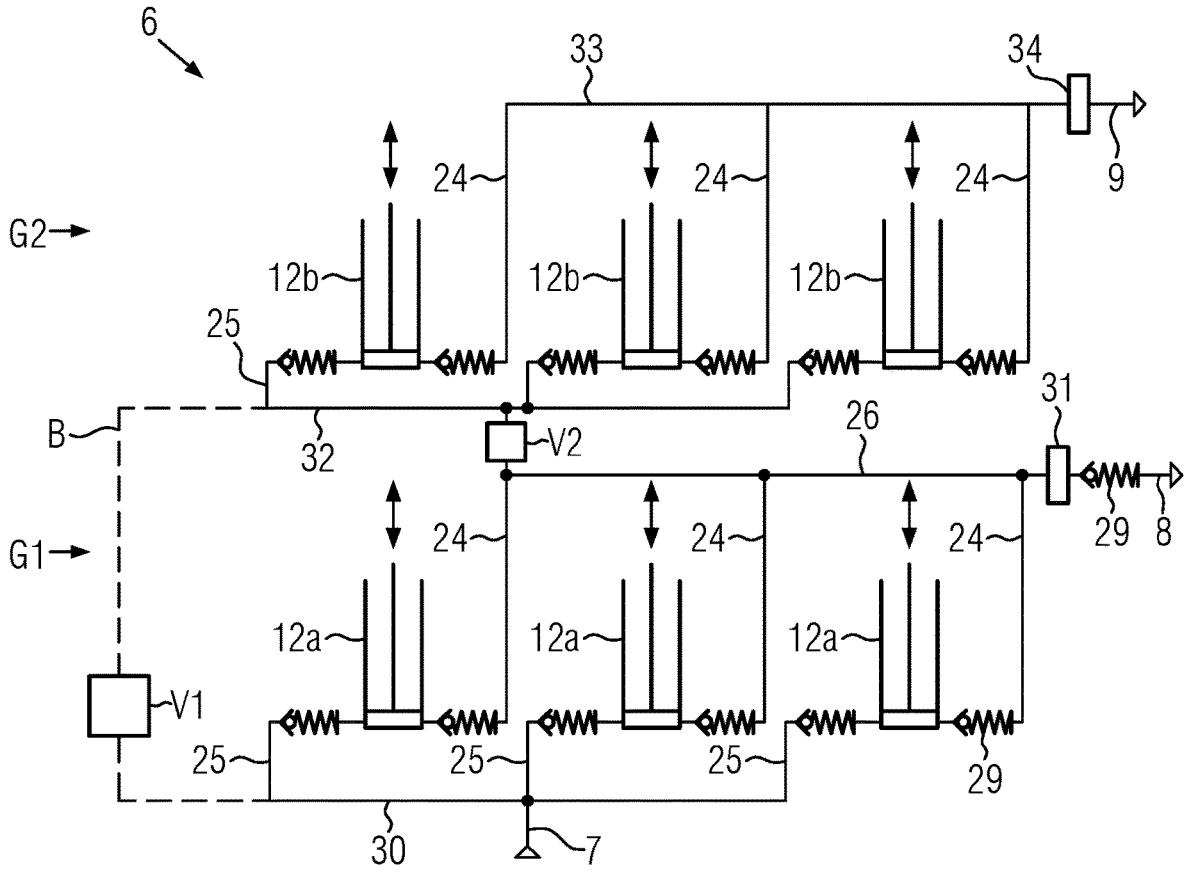
FIG. 4 is a schematic representation of a functional layout of a fluid pump assembly according to a first embodiment of the present invention.

FIG. 4 shows a schematic layout of a first embodiment of a functional layout of several pumps in a fluid pump assembly 6 of the present invention. In this embodiment, the fluid pump assembly 6 comprises six pumps 12 which may be again, arranged in a star-shaped configuration within a common pump housing 6. Each pump 12 can be provided with a check valve 29 at its high pressure port 24, and with a second check valve 29 at its low pressure port 25.

The high pressure ports 24 of a group G1 of three pumps 12*a*, in the following termed "first stage pumps 12*a*", may be interconnected to each other by the first manifold 26. The opposite, low pressure ports 25 of these three first stage pumps 12*a* may be operatively connected to each other by a second manifold 30. The second manifold 30 can be directly connected to the suction port 7 leading into the vacuum chamber 3, thereby connecting the low pressure port 25 of each of the three first stage pumps 12*a* to the vacuum chamber 3. The first manifold 26, on the other hand, can be connected via a closing valve 31 and a check valve 29 to the first vacuum port 8 of the fluid pump assembly 6. The closing valve 31 can be switched between an open and a closed state.

The three other pumps 12 may form a second group G2 and are subsequently called "second stage pumps 12*b*". Their low pressure ports 25 may be connected to each other and to the first manifold 26 by third manifold 32. The opposite high pressure ports 24 of the three second stage pumps 12*b* may be connected to each other by a fourth manifold 33. The fourth manifold can lead to the second vacuum port 9 via a second closing valve 34, which again is switchable between an open and a closed state.

It is important to note that the group G2 of second stage pumps 12*b* can be connected to the first group G1 of first stage pumps 12*a* operatively in series, i.e., with the low pressure ports 25 of the second stage pumps 12*b* being connected to the high pressure ports 24 of the first stage pumps 12*a*.

In dashed lines, FIG. 4 shows an alternative configuration in which the fluid pump assembly 6 additionally comprises a bypass B between the second manifold 30 and the third manifold 32. A controllable closing valve V1 is shown arranged on the bypass B, while a second, additional controllable closing valve V2 is shown arranged between the first manifold 26 and the third manifold 32.

In a first mode of operation of this alternative configuration of the fluid pump assembly 6, the closing valve V1 is open while the other closing valve V2 is closed. Hence, the second and third manifolds 30, 32 are connected via the bypass B such that all six pumps 12*a*, 12*b* are operatively connected to each other in parallel, i.e., their low pressure ports 25 are all coupled to the suction port 7. This allows a very rapid generation of a first level vacuum because all six pumps 12*a*, 12*b* participate in common.

In a second mode of operation of the alternative configuration, the closing valve V1 is closed and the second closing valve V2 is opened. In this second mode, operation corresponds to the second mode of operation described above with respect to FIG. 4, in which the three secondary pumps 12*b* operate in series with respect to the group G1 of first stage pumps 12*a*. Hence, in this second mode of operation, there are two levels of pumps, thereby allowing the generation of an even lower vacuum level.

A corresponding bypass B and switchable closing valves V1, V2 can be arranged in each of the embodiments of the fluid pump assembly 6 in any embodiment of the present invention.

Figure 5:
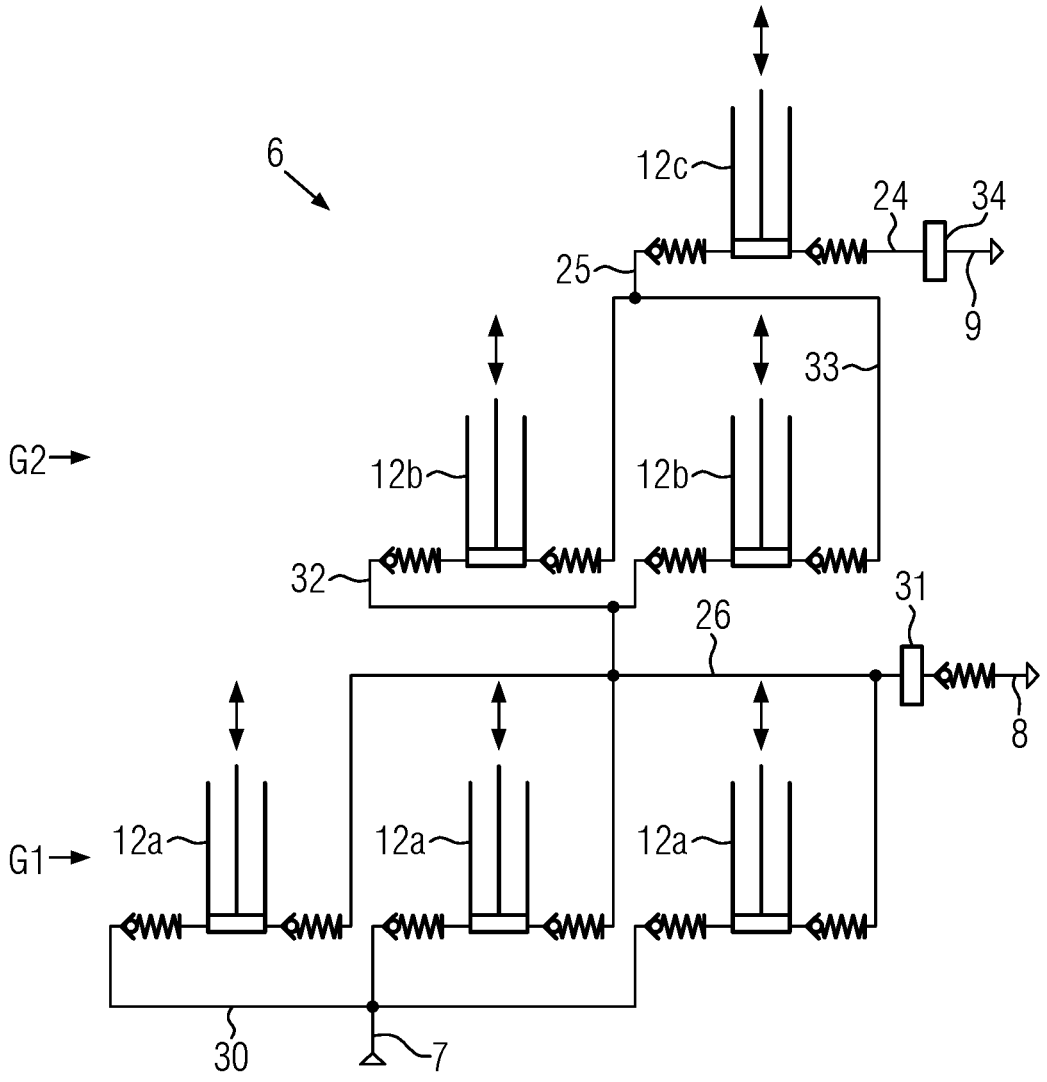
FIG. 5 is a schematic representation of a functional layout of a fluid pump assembly according to a second embodiment of the present invention.

FIG. 5 shows a second embodiment of the functional arrangement of six pumps 12 in fluid pump assembly 6 of the present invention. This embodiment largely corresponds to the embodiment of FIG. 4 described above—except for the second group G2 of second stage pumps 12*b* this time only comprising two pumps 12*b* (instead of three). A third second stage pump 12*c* is operatively connected to the fourth manifold 33 and, hence, to the group G2 in series. This is achieved by connecting the low pressure port 25 of this third pump 12*c* to the fourth manifold 33. The high pressure port 24 of this third second stage pump 12*c*, on the other hand, leads to the second vacuum port 9 via a check valve 29 and a second closing valve 34.

Figure 6:
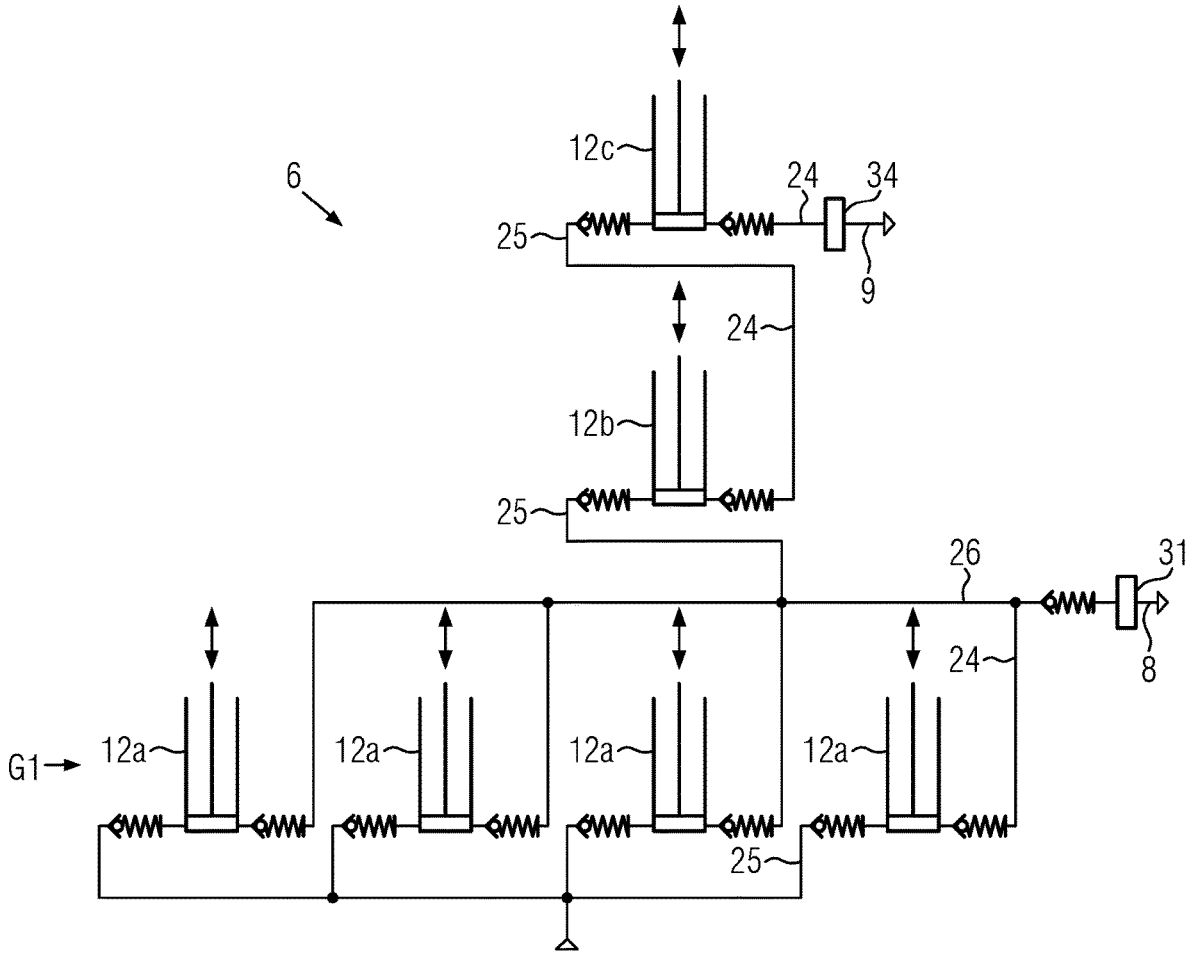
FIG. 6 is a schematic representation of a functional layout of a fluid pump assembly according to a third embodiment of the present invention.

FIG. 6 shows a third embodiment of a functional arrangement of six pumps 12 in a fluid pump assembly 6 of the present invention. In this embodiment, the first group G1 of pumps comprises four first stage pumps 12*a* connected to each other in parallel. This is achieved by connecting the high pressure port 24 of these four pumps 12*a* by a first manifold 26 which leads towards the first vacuum port 8. The low pressure ports 25 of the four first stage pumps 12*a* are connected to each other by the second manifold 30.

In addition to the group G1 of first stage pumps 12*a*, two second stage pumps 12*b*, 12*c* are provided. These second stage pumps 12*b*, 12*c* are operatively connected to each other and to the first group G1 in series. For this purpose, the low pressure port 25 of one second stage pump 12*b* is operatively connected to the first manifold 26 while the high pressure port 24 of this pump 12*b* is operatively connected to the low pressure port 25 of the other second stage pump 12*c* (called third level pump). The high pressure port 24 of this third level pump 12*c*, on the other hand, leads to the second vacuum port 9 via the second closing valve 34.

Figure 7:
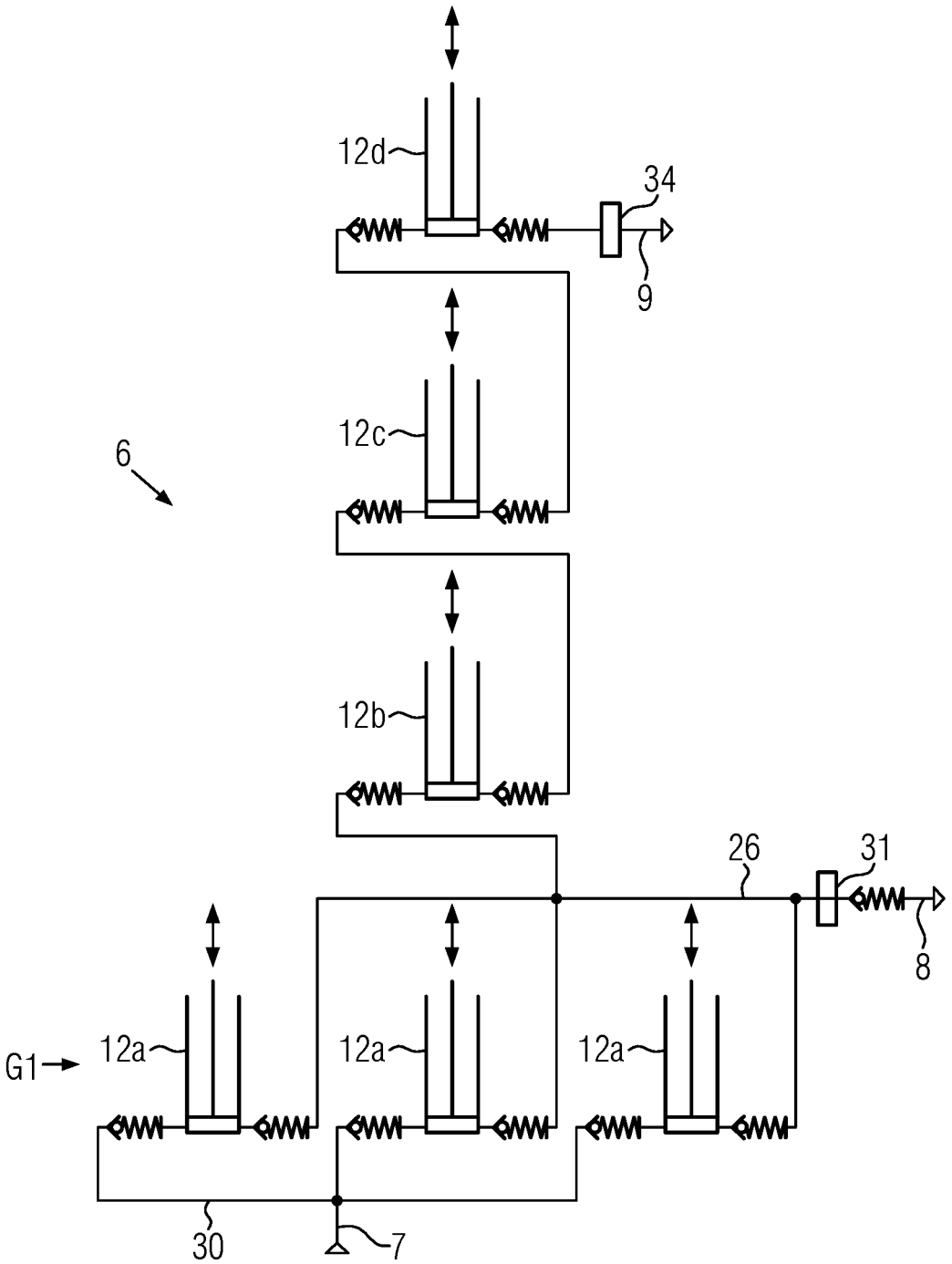
FIG. 7 is a schematic representation of a functional layout of a fluid pump assembly according to a fourth embodiment of the present invention.

Finally, FIG. 7 shows a fourth embodiment of a functional arrangement of six pumps 12 in a fluid pump assembly 6 of the present invention. This configuration is realized by the arrangement shown in FIG. 3. In this embodiment, the first group G1 of pumps 12 again comprises three first stage pumps 12*a* connected to each other in parallel, like in the embodiments of FIGS. 4 and 5. The three second stage pumps 12*b*, 12*d*, 12*d* are operatively connected to each other and to the group G1 of first stage pumps 12*a* in series. The first manifold 26 interconnecting the high pressure ports 24 of the first stage pumps 12*a* leads to the first vacuum port 8 while the second manifold 30 connecting the low pressure port 25 of the first stage pumps 12*a* leads to the suction port 7. The high pressure port of the second stage pump 12*d*, which is functionally most remote from the group G1 of first stage pumps 12*a*, i.e., the fourth level pump 12*d*, leads to the second vacuum port 9.

In the following, a method of operation of the packaging machine 1 according to one embodiment of the present invention, is going to be described.

In a first mode of operation, i.e., after having closed the cover 4 of the packaging machine 1, a first level vacuum can be generated with the group G1 of first stage pumps 12*a* connected to each other in parallel. For this purpose, air may be drawn from the vacuum chamber 3 via the suction port 7 and discharged via the first vacuum port 8. In this first mode of operation, the first closing valve 31 is in its open state. Due to the relatively large total volume of the two, three or more pumps 12*a* constituting the first group G1, the desired first level vacuum can be obtained rather quickly.

Optionally, it is possible to control the time elapsed (e.g., from starting the vacuum generation) or the pressure currently present in the vacuum chamber 3. After a certain time has elapsed, or after a certain vacuum level has been reached within the vacuum chamber 3, the fluid pump assembly 6 can be switched from its first mode to its second mode of operation. For this purpose, the first closing valve 31 is closed, and the second closing valve 34 is opened. Now, a vacuum is generated with all pumps 12 of the fluid pump assembly 6, i.e., with the first stage pumps 12*a* and the second stage pumps 12*b*, 12*c*, 12*d*. This leads to a generation of an even lower vacuum level.

For example, a second level vacuum of about 3 to about 25 millibar (mbar), for example about 15 millibar or about 5 millibar, is achievable within approximately two minutes, preferably within approximately one minute. The vacuum chamber 3 typically has a volume of about 4 to about 8 liters, e.g., about 5 liters.

The present invention may deviate in several aspects from the specific embodiments shown and described above. It has already been pointed out that the fluid pump assembly 6 may, for example, comprise five or six pumps 12. However, embodiments are conceivable which have only three or four pumps 12, or more than six pumps 12. Each of the two closing valves 31 and 34 is optional as such and can be omitted.

The fluid pump assembly according to any embodiment described herein may constitute an invention in itself, without being limited by its use and installation in a packaging machine.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A fluid pump assembly of the radial cylinder type for a packaging machine, the fluid pump assembly comprising:

a first group of a plurality of first stage pumps, the first group comprising at least three pumps, each pump having a piston guided in a cylinder, and each pump having a high pressure port and a low pressure port, an intake port of the first group of the plurality of first stage pumps being in fluid communication with a packaging machine;

a first manifold connecting the high pressure ports of the first group of the first stage pumps so that the pumps of this first group are operatively connected in parallel, a first exhaust port in fluid communication with said first manifold and a first valve for opening and closing said first exhaust port; and a second group of a plurality of second stage pumps, wherein the plurality of second stage pumps comprises at least three pumps operatively connected in series and in communication with a second exhaust port, and a second valve for opening and closing said second exhaust port, wherein the second group of the plurality of second stage pumps is operative connected to the first group of the first state pumps in series when said first valve is in a closed position; and wherein said first exhaust port and said second exhaust port exhaust to a surrounding environment.

2. Fluid pump assembly according to claim 1, wherein the plurality of second stage pumps is operatively connected in series to the high pressure ports of the first group of first stage pumps.

3. Fluid pump assembly according to claim 1, wherein all the pumps are driven by a common driving shaft.

4. Fluid pump assembly according to claim 1, wherein the first group of first stage pumps comprises three pumps.

5. Fluid pump assembly according to claim 1, wherein the first group of first stage pumps comprises four pumps.

6. Fluid pump assembly according to claim 1, wherein the plurality of second stage pumps comprises a subgroup of pumps, the pumps of this subgroup being operatively connected to each other in parallel.

7. Fluid pump assembly according to claim 1 further comprising a second manifold provided for connecting the low pressure ports of the first group of first stage pumps.

8. Fluid pump assembly according to claim 1, wherein the pumps are switchable between a first configuration in which all pumps are operatively connected to each other in parallel, and a second mode of operation in which the second stage pumps are operatively connected to the first group of pumps in series.

9. Fluid pump assembly according to claim 1 further comprising a bypass including a first controllable closing valve provided between the second manifold and the plurality of second stage pumps, and including a second controllable closing valve provided between the first manifold and the plurality of second stage pumps.

10. Method for generating a vacuum in a packaging machine with a fluid pump assembly of the radial cylinder type, comprising a plurality of at least three pumps, each pump having a piston guided in a cylinder, and each pump having a high pressure port and a low pressure port, the method comprising the steps of:

operating a first group of first stage pumps to generate a first vacuum in the packaging machine and to deliver air drawn by the first group of first stage pumps to a first port which exhausts into the surrounding environment, the members of the first group of first stage pumps being operatively connected in parallel;

closing the first port; and operating the first group of first stage pumps and a second group of three second stage pumps being operatively connected to each other and to the first group of pumps in series to generate a second vacuum in the packaging machine and to deliver air drawn by the first group of first stage pumps and the second group of three second stage pumps to a second port which exhausts into the surrounding environment.

11. Method according to claim 10 further comprising the steps of:

monitoring at least one of a pressure and an elapsed time; and closing the first port when a predetermined pressure has been reached or a predetermined time has elapsed.

12. A method for generating a vacuum in a packaging machine with a fluid pump assembly of the radial cylinder type, comprising a plurality of at least three pumps, each pump having a piston guided in a cylinder, and each pump having a high pressure port and a low pressure port, the method comprising the steps of:

operating a first group of pumps to generate a first vacuum pressure in the packaging machine and to deliver air drawn by the first group pumps to a first exhaust port in a first operating mode, wherein the first group of pumps comprises two or more first stage pumps being operatively connected in parallel, and wherein the first exhaust port is in fluid communication with an outside environment at an ambient air pressure;

closing the first exhaust port and opening a second exhaust port, wherein the second exhaust port is in fluid communication with the outside environment at ambient air pressure;

operating both the first group of pumps and at least one second stage pump after the opening of the second exhaust port in a second operating mode, wherein the at least one second stage pump is operatively connected to the first group of pumps in series to generate a second vacuum pressure in the packaging machine and to deliver air drawn by the first group of pumps and the at least one second stage pump to the second exhaust port; and switching the operation of the first group of pumps and the at least one second stage pump between the first operating mode, and the second operating mode.

13. The method according to claim 12, wherein the operation of the at least one second stage pump comprises the generation of vacuum by a plurality of pumps which are operatively connected in series to each other.

14. The method according to claim 12 further comprising the steps of:

monitoring at least one of a pressure and an elapsed time; and closing the first exhaust port when a predetermined pressure has been reached or a predetermined time has elapsed.

15. The method according to claim 12 wherein the at least one second stage pump comprises a second group of pumps comprising three pumps connected in parallel, and wherein the first group of pumps is operably connected to the second group of pumps in series.

16. The method according to claim 12 wherein the first group of pumps comprises three pumps.

17. A method for generating a vacuum in a packaging machine with a fluid pump assembly of the radial cylinder type, comprising a plurality of at least three pumps, each pump having a piston guided in a cylinder, and each pump having a high pressure port and a low pressure port, the method comprising the steps of:

arranging two or more first stage pumps in a first group of pumps, wherein the two or more first stage pumps are arranged in parallel, and wherein the first group of pumps is in fluid communication with a suction port in the packaging machine and a first exhaust port, wherein the first exhaust port is in communication with an environment at an ambient air pressure;

arranging at least one second stage pump in fluid communication with the first group of pumps and a second exhaust port, wherein the at least one second stage pump is operably connected to the first group of pumps in series;

operating only the first group of pumps in a first mode of operation to generate a first vacuum pressure at the suction port of the packaging machine and to deliver air drawn by the first group of pumps to the first exhaust port;

closing the first exhaust port and opening the second exhaust port;

operating both the first group of pumps and the at least one second stage pump after the opening of the second exhaust port in a second mode of operation to generate a second vacuum pressure at the suction port and to deliver air drawn by the first group of pumps and the at least one second stage pump to the second exhaust port; and switching the operation of the first group and the at least one second stage pump between the first mode of operation and the second mode of operation.

* * * * *